US005660686A

United States Patent [19]

Henricson et al.

[11] Patent Number: 5,660,686

[45] Date of Patent: Aug. 26, 1997

[54] COOKING WITH SPENT LIQUOR PRETREATMENT OF CELLULOSE MATERIAL

[75] Inventors: Kaj O. Henricson, Kotka; Pekka Tervola, Helsinki, both of Finland

[73] Assignee: Ahlstrom Machinery Inc., Glen Falls, N.Y.

[21] Appl. No.: 403,932

[22] Filed: Mar. 14, 1995

Related U.S. Application Data

[63] Continuation-in-part of Ser. No. 345,822, Nov. 21, 1994, which is a continuation-in-part of Ser. No. 299,103, Sep. 2, 1994, abandoned.

[51] Int. Cl.[6] ..... D21C 7/14; D21C 3/26

[52] U.S. Cl. ..... 162/41; 162/248

[58] Field of Search ..... 162/19, 39, 40, 162/41, 47, 237, 239, 241, 248, 249

[56] References Cited

U.S. PATENT DOCUMENTS

| | | | |
|---|---|---|---|
| 5,053,108 | 10/1991 | Richter | 162/237 |
| 5,080,755 | 1/1992 | Backlund | 162/19 |
| 5,256,255 | 10/1993 | Fagerlund | 162/237 |
| 5,522,958 | 6/1996 | Li | 162/19 |

FOREIGN PATENT DOCUMENTS 0517689 5/1992 European Pat. Off. .

OTHER PUBLICATIONS

Nils Hartler, "Extended Delig . . . New Concept", 1978 Svensk Pappersidning 15:483 (pp. 1–2) 1978.

Johan Engstrom, "Black Liquor . . . Kraft Cooking", Paper and Timber vol. 76, pp. 59–66 Jan. 2, 1994.

Disa Tormund, "New Findings . . . Pulping Liquors", Tappi Journal, pp. 205–210 May 1989.

*Primary Examiner*—Donald E. Czaja

*Assistant Examiner*—Dean T. Nguyen

*Attorney, Agent, or Firm*—Nixon & Vanderhye P.C.

[57] ABSTRACT

A method and continuous digester system provide for a high $Na_2S$ concentration in the beginning of the cook of comminuted cellulosic fibrous material to produce cellulose pulp, providing a more selective cook and potential to lower cooking kappa. Two different streams of spent (e.g. "sulphurous" and "black") liquor are removed from different screens associated with continuous digesters. The spent liquor removed from the uppermost screen has a relatively high effective alkali and $Na_2S$ concentration. The second spent liquor, removed from the second screen, has effective alkali and $Na_2S$ concentrations which are at least 25% less than for the first spent liquor. The first spent liquor is circulated to an impregnation vessel, or other part of a chip feed system, to enhance the amount of sulphur present at the beginning of the cooking stage in the digester. The second spent liquor may be used in a number of ways, including—with or without first passing it through a flash tank—circulating it to a chip slurrying system for slurrying the chips so that they can be fed to the digester. The steaming and slurrying system may include only an unpressurized chip bin, chip feeder, slurrying vessel, and high pressure feeder, thus being simpler than conventional constructions.

28 Claims, 11 Drawing Sheets

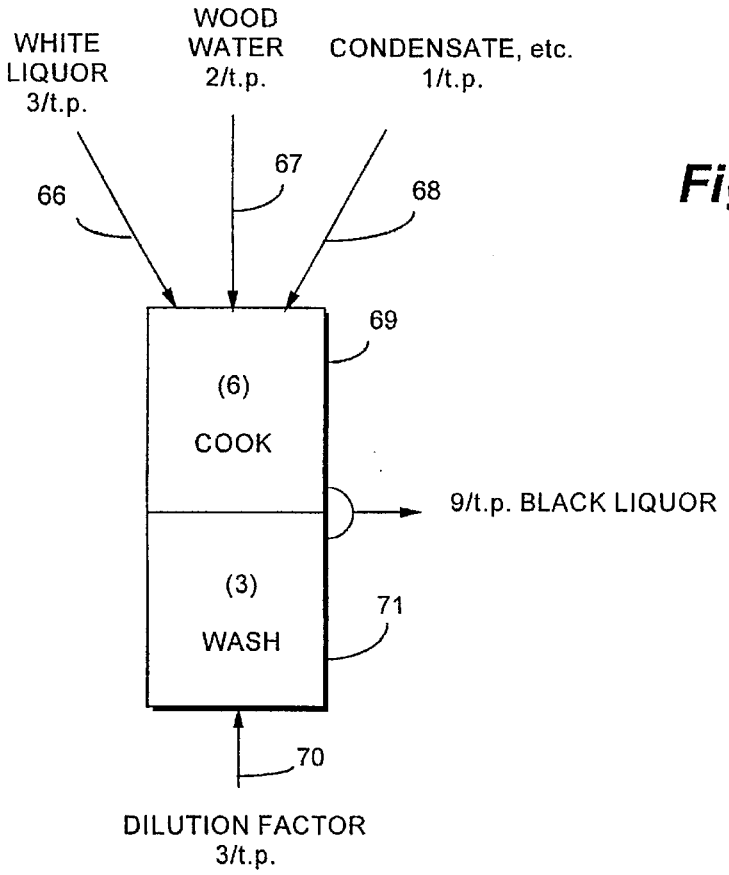
*Fig. 9* PRIOR ART
*Fig. 10*
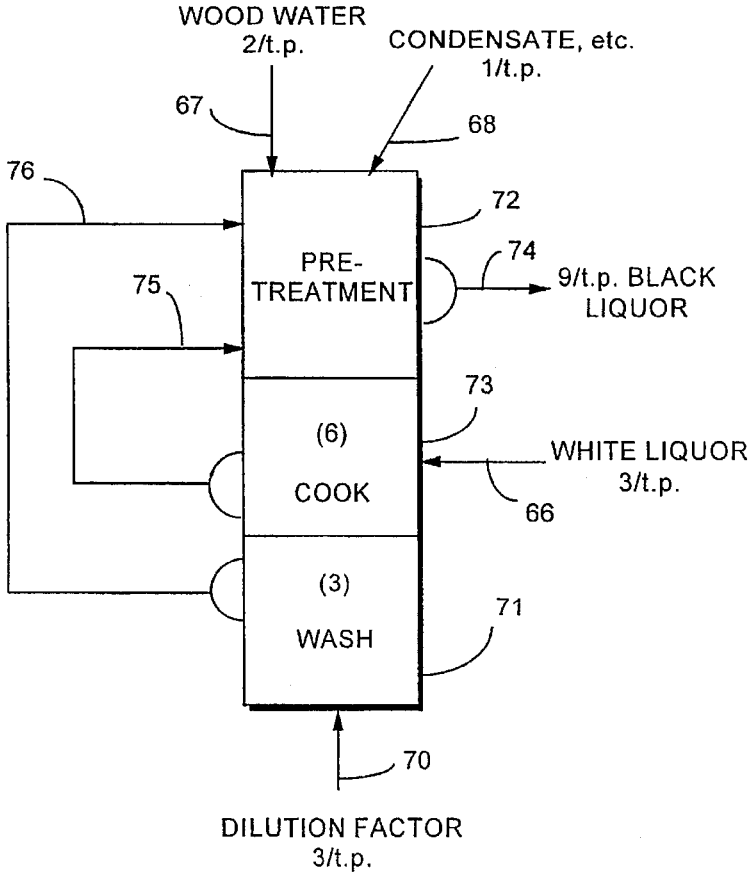

COOKING WITH SPENT LIQUOR PRETREATMENT OF CELLULOSE MATERIAL

CROSS-REFERENCE TO RELATED APPLICATION

This application is a continuation-in-part of application Ser. No. 08/345,822 filed Nov. 21, 1994, which in turn is a continuation-in-part of Ser. No. 08/299,103 filed Sep. 2, 1994 now abandoned.

BACKGROUND AND SUMMARY OF THE INVENTION

In kraft cooking, wood is delignified by a cooking liquor where the active components are $Na_2S$ and NaOH. $Na_2S$ is preferably primarily active at the beginning of the cook, and NaOH is preferably active at the end of the cook. The invention relates to a method of increasing $Na_2S$ concentration in the beginning of the cook. A high $Na_2S$ concentration in the beginning of the cook gives a more selective cook and the possibility of lowering pulp kappa.

Spent kraft cooking liquor, or black liquor, has been re-circulated for re-use in various fashions in prior art continuous kraft cooking systems. For example in U.S. Pat. No. 3,802,956, black liquor is added to the feed system of a continuous digester to aid in flushing chips from the high pressure transfer device (i.e., the high pressure feeder) to the top of the impregnation vessel. In U.S. Pat. Nos. 5,080,755 and 5,192,396 black liquor is used to supplement the liquor extracted in the impregnation vessel. These patents disclose a method of introducing co- and counter-current chip impregnation in an impregnation vessel by extracting liquor at a midpoint in the so vessel. The re-circulated black liquor is used to increase the liquor volume (i.e., the liquor-to-wood ratio) to limit the alkali concentration increase caused by the extraction. The black liquor also improves the chip column movement.

In the early 1980s, based upon work performed by Sjoblom et al at the Swedish Royal Institute of Technology, it was recognized that the presence of sulfides in the early stages of kraft cooking can improve the strength of the resulting pulp. Attempts have been made to use the sulfides present in black liquor to provide the sulfide desired. U.S. Pat. Nos. 5,053,108 and 5,236,553 disclose a method of continuous kraft cooking in which black liquor is re-circulated to the feed system to treat the wood chips. In the '108 patent this treatment takes place in the chip chute and is referred to as "sulfonation". In the '553 patent, the black liquor is re-circulated to a chip chute/slurrying vessel. In both patents a single source of black liquor is used.

Recent mathematical modeling pursuant to the invention suggests that a preferred method of pre-treating chips is by using two forms of black liquor: one of relatively weak sulfide concentration and one of relatively strong sulfide concentration. The invention provides such two different streams in a practical manner.

According to one aspect of the present invention, a method of continuously kraft cooking comminuted cellulosic fibrous material utilizing an upright continuous digester having first and second extraction screens, a top, and a bottom, is provided. The method comprises the steps of continuously: (a) Feeding comminuted cellulosic fibrous material slurry to the top of the digester. (b) Cooking the material in the digester as it passes downwardly therein, at a cooking temperature of about 150°–180° C., producing spent liquor during cooking while digesting the material. (c) Using the first so extraction screen, withdrawing a first spent liquor from the digester having a first $Na_2S$ concentration (and typically a first amount of effective alkali). (d) Using the second extraction screen, withdrawing a second spent liquor from the digester having a second $Na_2S$ concentration (and typically a second amount of effective alkali) at least 25% less than the first $Na_2S$ concentration (and typically at least 25% less than the first amount of effective alkali). (e) Combining at least some of the first spent liquor with the material prior to step (b) to enhance the amount of sulfur present at the beginning of step (b). And, (f) withdrawing pulp from the bottom of the digester.

In the practice of the method described above, step (c) is typically practiced to extract as the first spent liquor a liquor having an effective alkali concentration of about 10–50 g/l and an $Na_2S$ concentration (assuming original sulfidity of the cooking liquor of greater than about 25%) of greater than about 15 g/l, possibly greater than about 35 g/l. The first liquor is also typically at a temperature of about 140°–170° C. and in an amount of about 2–6 $m^3$/ton of pulp (t.p.). The extracted liquor may be treated to improve its usefulness in the impregnation and cooking. Suitable treatments are, e.g. flashing to separate gases and raise concentration, evaporation to raise concentration, separation of organics like lignin to lower dry solids content, heating to change the structure of organic material and sulphur, raising or lowering the temperature, and filtration.

Step (d) of the above method is typically practiced to extract as the second spent liquor a liquor having an effective alkali concentration of about 3–20 g/l (typically half or less of the concentration of the first liquor), and an $Na_2S$ concentration of less than about 20 g/l (typically less than half of that of the first liquor). The second liquor typically has a temperature of about 120°–160° C. and is extracted in an amount of about 2–6 $m^3$/t.p. The extracted liquor may be treated to improve its usefulness in the impregnation and cooking. Suitable treatments are, for example, flashing to separate gases and raise concentration, separation of organics like lignin to lower dry solids content, heating to change structure of organic material and sulphur, raising or lowering temperature and filtration.

The digester may comprise a two vessel hydraulic system including a first impregnation vessel, in which case step (e) may be practiced to introduce the first spent liquor into the bottom of the impregnation vessel to flow co-currently or countercurrently to the material therein, or the digester may comprise a single vessel hydraulic digester in which case the first liquor may be introduced into the slurry co- or countercurrently any time prior to the practice of step (a).

The second spent liquor may be flashed to steam in a flash tank, and a more concentrated second spent liquor which is withdrawn from the bottom of the flash tank may be used to slurry the comminuted cellulosic fibrous material prior to step (a). For example, where a high pressure transfer device is provided (high pressure feeder) having a feed circulation loop, which transfer device feeds slurry to the top of the digester (either directly or through an impregnation vessel), the more concentrated second spent liquor may be introduced into contact with the material in the feed circulation loop of the high pressure transfer device, i.e. slurrying the material. The first liquor may also be flashed if desired, before adding it to the cellulosic material upstream of the digester cooking zone. Such a flashing may be useful to separate gases that otherwise could disturb the operation of the system. Another reason to flash is to lower the temperature if this is found necessary.

In order to enhance further the amount of sulphur present at the beginning of the cook, there may be the further step of supplementing the first spent liquor with just above 0 to about 2 $m^3$/ton of pulp of green liquor. Other liquors that can be added are white liquor or sodium hydroxide. By the addition of green liquor, white liquor and sodium hydroxide the sodium-sulphur balance can be adjusted.

Additive chemicals like polysulfide and anthraquinone can be used in this process. For example the polysulfide should be added to the pretreatment phase to raise sulfide ion concentration. Anthraquinone is a catalyst that is only partly consumed during cooking. By the recirculation system a recirculation of anthraquinone is obtained lowering the usage of fresh costly anthraquinone. Other additives to the cooking process, for example, chelating agents, such as EDTA, can be used in a similar manner.

According to another aspect of the present invention a method of continuously digesting comminuted cellulosic fibrous material to produce cellulose pulp comprises the steps of substantially consecutively and continuously: (a) Slurrying the material with liquor. (b) Treating the material with a first sulphurous liquor having an effective alkali concentration of about 10–50 g/l and an $Na_2S$ concentration of at least about 15 g/l (e.g. 15–60 g/l), and possibly at least 35 g/l (e.g. 40–60 g/l), although preferably about 20–30 g/l. (c) Cooking the material by adding a cooking liquor having an effective alkali concentration of over 100 g/l and a sulfidity of at least about 25% at a cooking temperature of about 150°–180° C. (e.g. 150°–175° C.) to produce pulp. (d) Separating the first sulphurous liquor from the pulp. (e) Separating a second liquor from the pulp having a different effective alkali concentration and $Na_2S$ concentration than the first liquor. And, (f) washing the pulp.

In the practice of the above method, step (a) may be practiced, at least in part, using the second liquor from step (e). The first and second liquors preferably have the temperature ranges and volumes described above with respect to a first aspect of the present invention. The second liquor typically has an effective alkali concentration of about 3–20 g/l (e.g. about 10 g/l) and less than the effective alkali concentration of the first liquor, and has an $Na_2S$ concentration of less than about 20 g/l (e.g. about 5–15 g/l).

According to another aspect of the present invention a continuous digester system is provided. The continuous digester system comprises the following elements: An upright digester vessel having a top and a bottom. A chip slurry feed inlet adjacent the top of the vessel. A chip feed system connected to the chip feed inlet. A pulp outlet adjacent the bottom of the vessel. A separating device adjacent the top of the vessel for separating some liquor from chips fed into the chip feed inlet and returning it to the chip feed system. At least one upper screen in the vessel distinct from the separating device. A first extraction screen in the vessel below the at least one upper screen for extracting a first spent liquor. A second extraction screen in the vessel below the first extraction screen for extracting a second spent liquor distinct from the first spent liquor. And, a first conduit for circulating the first spent liquor to the chip feed system.

In the continuous digester system described above, a chip slurrying system is also preferably provided connected to the chip feed system opposite the digester. A second conduit is also provided for circulating liquor from the second extraction screen to the slurrying system. The second conduit may be connected directly to the slurrying system, or through one or more flash tanks.

The invention also may include a simplified steaming and so slurrying system associated with the digester. For example instead of utilizing a chip bin, chip meter, chip feeder, horizontal steaming vessel, slurrying vessel, and high pressure feeder, the steaming and slurrying system may consist essentially of only a chip bin, chip feeder, slurrying vessel (e.g. chute), and high pressure feeder.

The continuous digester system may comprise any of a wide variety of conventional digester systems including digesters available from Kamyr, Inc. of Glens Falls, N.Y. and sold under the trademarks MCC®, EMCC®, and LO-SOLIDS™; the continuous digester system may include a single vessel hydraulic system, a two vessel hydraulic system (with an impregnation vessel in addition to the digester), or other conventional systems. Where an impregnation vessel is utilized, the first conduit may be connected to the impregnation vessel to introduce the first spent liquor into the impregnation vessel. In the impregnation vessel the first, sulphurous, liquor typically flows countercurrently to the cellulosic material, but may instead be directed to flow co-currently.

According to still another embodiment of the invention a method of continuously kraft cooking comminuted cellulose material is provided, comprising the following steps: (a) Treating the material with a first black liquor for at least 10 minutes at a temperature between 80°–110° C. (b) Treating the material with a second black liquor for at least 10 minutes at a temperature between 110°–140° C. (c) Adding cooking liquor to the material, and cooking the material at a temperature between 150°–180° C. producing black liquor during cooking of the material. (d) Withdrawing the second black liquor, from the digester, having a concentration of sulfide ions, and using at least part of the second black liquor during the practice of step (b). And, (e) withdrawing the first black liquor from the digester having a concentration of sulfide ions lower than that of the second black liquor, and using at least part of the first black liquor during the practice of step (a).

It is the primary object of the present invention to provide two or more different streams of spent cooking liquors so as to provide a high $Na_2S$ concentration in the beginning of a kraft cook, resulting in a selective cook, better pulp strength and the potential to lower cooking kappa (i.e. easily below 20), and a simplified chip feeding system. This and other objects of the invention will become clear from an inspection of the detailed description of the invention and from the appended claims.

BRIEF DESCRIPTION OF THE DRAWINGS

FIG. 9 is a schematic illustration of the water balance of a traditional cooking system;

FIG. 10 is a schematic illustration of the water balance of a cooking system with the pretreatment in accordance with the present invention;

DETAILED DESCRIPTION OF THE DRAWINGS

Figure 1:
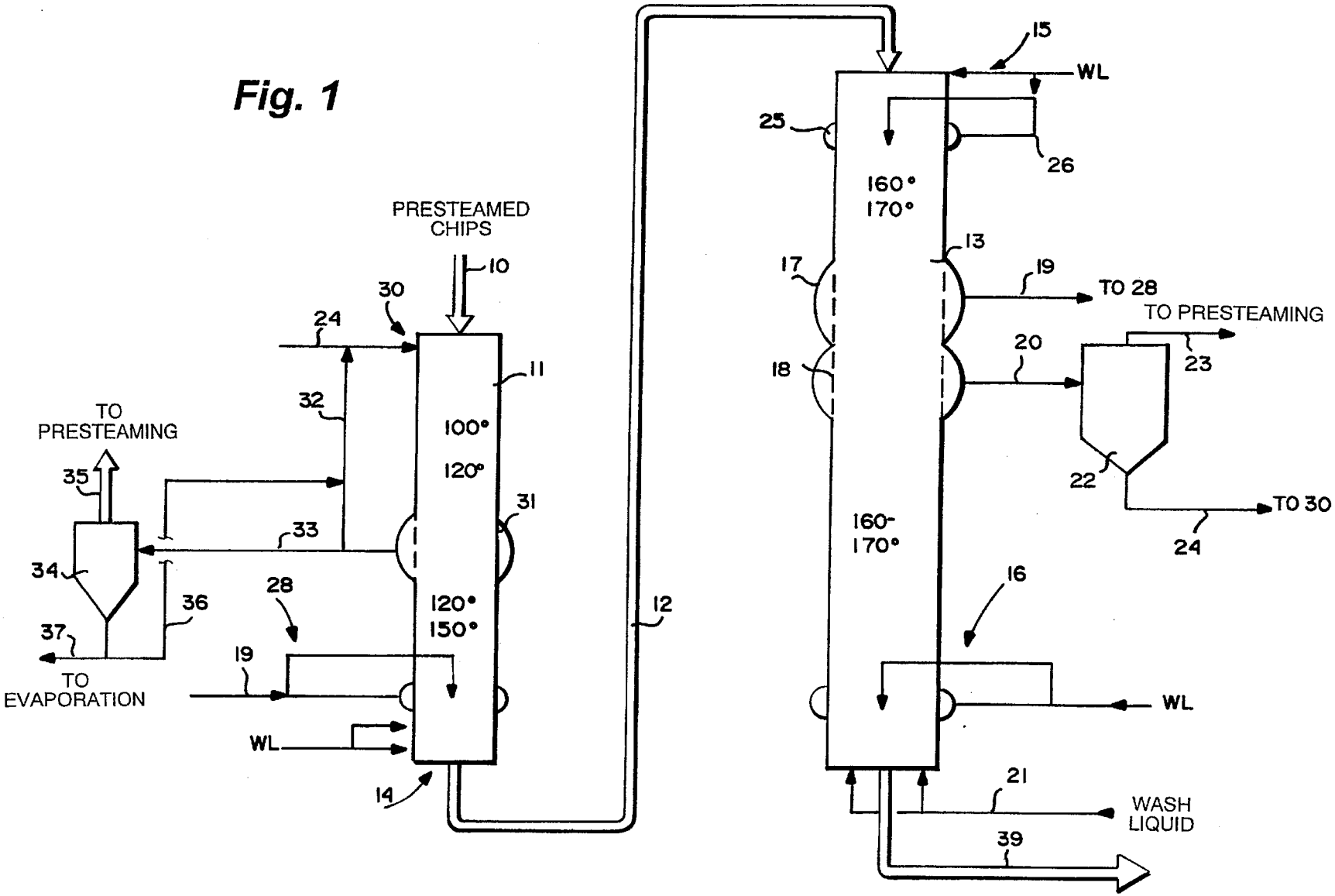
FIG. 1 is a schematic view of exemplary apparatus for practicing the method of continuous kraft cooking with black liquor pretreatment according to the present invention.

Exemplary apparatus for practicing an exemplary method according to the present invention is shown schematically in FIG. 1. In the description of FIG. 1, and the other figures that follow, the comminuted cellulosic fibrous material that is digested to produce cellulose pulp will be referred to as "chips", since wood chips are typically used in the production of cellulose pulp. However it is to be understood that a wide variety of different types of cellulosic material can be utilized besides wood chips.

Presteamed chips in line 10 are fed to a first, impregnation, vessel 11. The chips 10 are presteamed and pressurized in a slurrying and steaming system shown in FIGS. 2 or 3. From the vessel 11 the chips are transported via line 12 to the digester 13. Cooking liquor, typically white liquor (WL), primarily comprising $Na_2S$ and NaOH as the active ingredients, is added to the lower portion 14 of vessel 11 and upper portion 15 of vessel 13. Additional cooking liquor may be added to even out the alkali profile according to cooking methods such as those using MCC®, EMCC® or LO-SOLIDS™ digesters. As an example, WL is added in FIG. 1 to so the bottom 16 of vessel 13.

Initially the chips are steamed to remove air and to allow ready penetration by impregnating and cooking liquors, as is conventional. The actual cooking takes place in upper parts of digester 13. During the end and later parts of the cook the NaOH concentration decreases. According to the invention, the cooking vessel 13 is equipped with two separate extraction screens 17 and 18. With the first extraction screen 17 is extracted liquor surrounding the chips which liquor still contains active cooking chemicals NaOH and $Na_2S$. This first, spent, extracted liquor in conduit 19 is, due to the cooking kinetics, rich in $Na_2S$ and very useful in the beginning of the cook (e.g. at the top of vessel 13), but not as useful where it is present at the end of the cook where primarily NaOH is needed. This first, spent liquor, which may be called sulphurous liquor, is thus separated to be used in earlier phases of the cook. Typical properties of the sulphurous liquor in line 19 are ("p" means "ton of pulp"):

temperature 155° C. (140°–180° C.)

effective alkali 20 g/l (10–50 g/l)

amount 4 $m^3$/tp (2–6 $m^3$/tp)

$Na_2S$ >15 g/l (e.g. 15–60 g/l, preferably 20–30 g/l) [Note that all chemical concentrations are based upon equivalent NaOH].

After the useful sulphurous liquor has been separated, the cook continues for a while after which a second, spent residual liquor, called black liquor, is separated by second screen 18 into second conduit 20. The black liquor in conduit 20 contains residual cooking chemicals and dissolved lignin and wash liquid introduced into conduit 21 used to wash the pulp. Typical properties of the black liquor in conduit 20 are:

temperature 150° C. (120°–160° C.)

effective alkali 10 g/l (3–20 g/l)

amount 4 $m^3$/tp (2–6 $m^3$/tp)

$Na_2S$ <20 g/l

The second spent liquor (black liquor) in conduit 20 is so depleted in cooking chemicals that it has limited potential as a cooking liquor. However it can be utilized in a number of different ways before it is ultimately passed to a conventional recovery system. For example, it can be used to pretreat chips so that some sulfur is absorbed and some wood dissolved. Also, as illustrated in FIG. 1, it may pass to a flash tank 22 to produce steam 23 that is used in presteaming the chips 10, with a more concentrated second (black) liquor removed from the flash tank in line 24.

Note that the first and second extraction screens 17, 18 respectively are toward the end of the cooking zone in the digester 13. In the exemplary embodiment illustrated in FIG. 1 these screens are located near the middle of the digester 13, but below at least one upper screen 25, the upper screen 25 illustrated in FIG. 1 is associated with the conventional recirculation loop 26, to which white liquor may be added if desired. Typical white liquor that is used will have an active alkali content of at least about 100 g/l, and a sulfidity of at least about 25%. The sulfidity may vary depending upon where the white liquor is introduced. For example using known "split sulfidity" techniques, the liquor introduced initially (e.g. at 14, 15) may have higher sulfidity (e.g. above 40%), while white liquor introduced later on (e.g. at 16) lower sulfidity (e.g. below 30%). The temperature during cooking is around 160° C., preferably about 150°–180° C.

The first spent liquor from conduit 19 is mixed with the impregnated chips in line 12 prior to introduction into the top 15 of the digester 13. [The first liquor may also be flashed to recover steam or even heated, if desired, before being mixed with the presteamed chips in line 10.] This is preferably accomplished—as illustrated in FIG. 1—by introducing it into the recirculatory loop 28 at the bottom of impregnation vessel 11. In this case the first, sulphurous, liquor flows upwardly in the impregnation vessel 11 countercurrent to the flow of chips (downward) adjacent the bottom of the vessel 11. The temperature at the circulation 28 is typically about 155° C. (130°–160° C). Here the sulphurous liquor reacts with the wood and sulphur diffuses into the chips. Typical reaction and diffusion times are about 30 minutes (e.g. 20–40 minutes).

Preferably—as also illustrated in FIG. 1—the second spent liquor (black liquor) from conduit 24 is introduced into the vessel 11 adjacent the circulation 30, slurrying the presteamed chips in conduit 10. Here the temperature is about 70°–120° C. The black liquor flows downwardly with the chips in the vessel 11 until the intermediate extraction screen 31 is reached.

The extraction screen 31 extracts "final" black liquor. For example, two different streams may be provided, a first stream 32 which is recirculated back to the line 24 for introduction at 30 to slurry the chips, and a second portion 33 which is fed to the flash tank 34. Steam 35 produced in flash tank 34 is fed to presteam the chips in line 10, and a first portion of the more concentrated black liquor which is extracted from the bottom of the flash tank 34 may flow in line 36 back to the line 32 to slurry the chips. The majority of the concentrated black liquor from flash tank 34 passes in line 37 to evaporators in a conventional chemical recovery loop for a kraft mill.

After or during addition of the cooking liquor, the temperature of the slurry is raised to cooking temperature which is about 160° C. (150°–180° C.). Ultimately the chips are typically washed in the bottom of the digester 13 with the wash liquor introduced in line 21, whether an MCC®, EMCC®, or a LO-SOLIDS™ digester is utilized, and the pulp produced is withdrawn in line 39 from adjacent the bottom of the digester 13. The white liquor may be added at one or several points during cooking and impregnation. The white liquor can be preheated to improve heat economy.

Figure 2:
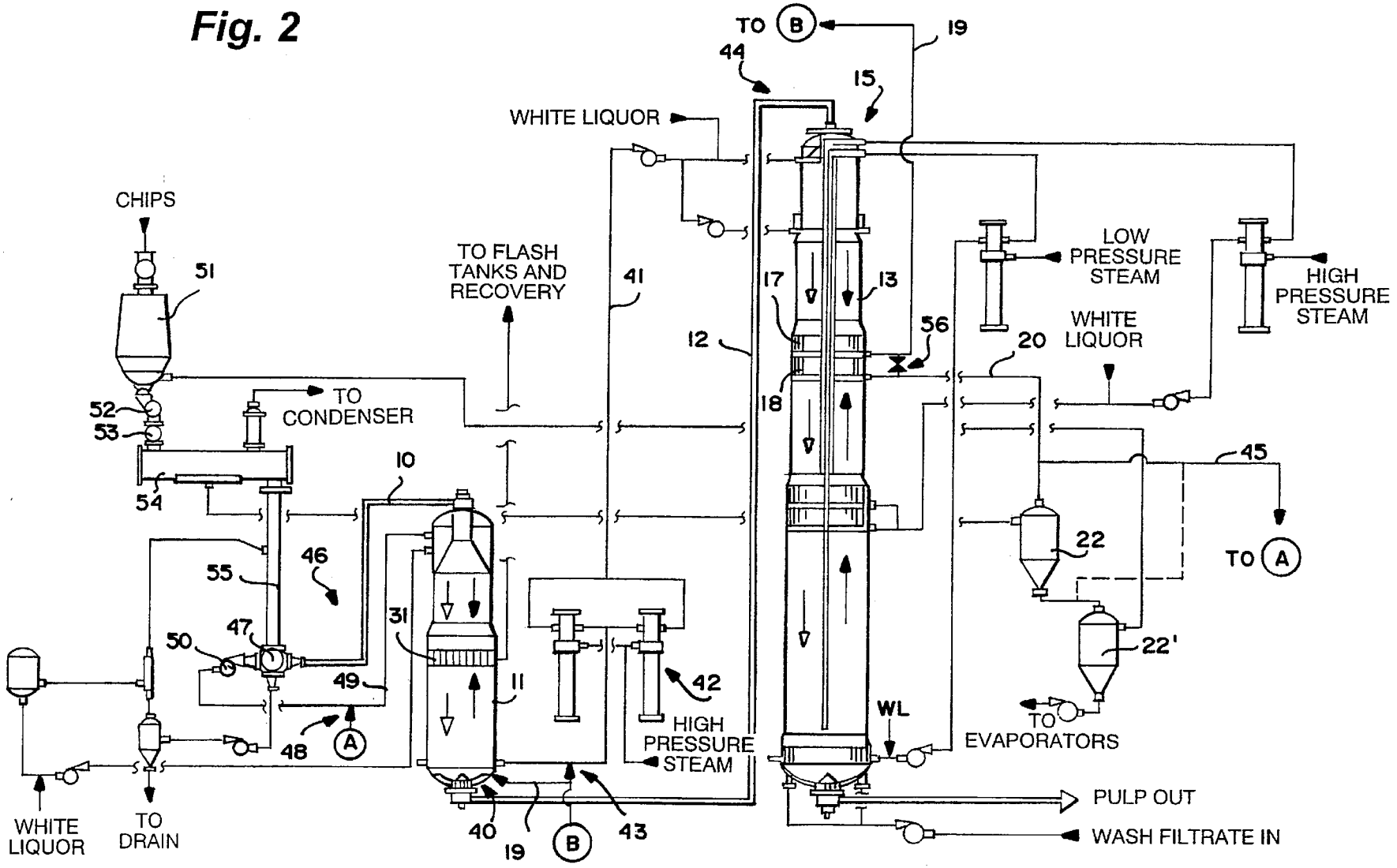
FIG. 2 is a view like that of FIG. 1 utilizing a conventional Kamyr® two vessel hydraulic digester system with co-current liquor flow in the top of the digester.

FIG. 2 schematically illustrates a second form of the invention in which the teachings of the invention are employed with a conventional two vessel hydraulic KAMYR® continuous digester system. In this embodiment structures comparable to those in the FIG. 1 embodiment are shown by the same reference numeral.

In the FIG. 2 embodiment the conventional upper and lower extraction screens correspond to the first and second extraction screens 17, 18 according to the present invention. The first spent (sulphurous) liquor withdrawn in conduit 19 is used—as in the FIG. 1 embodiment—to treat the chips prior to cooking, and therefore is introduced into the bottom of the impregnation vessel 11 as indicated generally at 40 in FIG. 2—or in the recirculation line 41 between the top 15 of the digester 13 and the bottom of the impregnation vessel 11, typically right before the heaters 42, or—alternatively or in addition—after the heaters 42, as illustrated at 43 in FIG. 2. A conventional separating device—shown schematically at 44 in FIG. 2—such as a screen assembly, or alternatively a "stilling well", or a conventional top separator, is used to separate some of the slurrying liquid from the introduced chips to be fed to the line 41.

In the FIG. 2 embodiment at least some of the second spent liquor (black liquor) removed via screen 18 into conduit 20 is used to slurry the chips. In the embodiment illustrated in FIG. 2 so some of the black liquor in line 20 passes to the flash tanks 22, 22' and this concentrated black liquor is then passed to evaporators and to other conventional chemical recovery system components. However some of the black liquor—in line 45—is used to slurry the chips, for example being introduced into the recirculation loop 46 associated with a high pressure transfer device (feeder) 47, as indicated at 48 in FIG. 2. The high pressure transfer device 47 and loop 46 associated therewith are conventional in two vessel hydraulic systems for feeding presteamed chips in line 10 to the top of the impregnation vessel 11, and the black liquor introduced at 48 is introduced in the recirculatory line 49 from the top of the impregnation vessel 11 to the high pressure pump 50 associated with the high pressure feeder 47.

FIG. 2 also illustrates a conventional steaming system for producing the steamed chips, which are slurried before passing into conduit 10 and before being introduced to the top of impregnation vessel 11. FIG. 2 illustrates a pressurized chip bin 51 with a chip meter 52, low pressure feeder 53, horizontal steaming vessel 54, and vessel—chute—55 in which a liquid level is established for liquid that will slurry the steamed chips discharged from horizontal steaming vessel 54.

In the FIG. 2 embodiment, a valve 56 may be provided, if desired, between the first and second conduits 19, 20, to make minor adjustments in the amount of spent liquor flowing in each of the conduits 19, 20 if more liquor is needed in one conduit than the other. The valve 56 is controlled automatically as is conventional.

Figure 3:
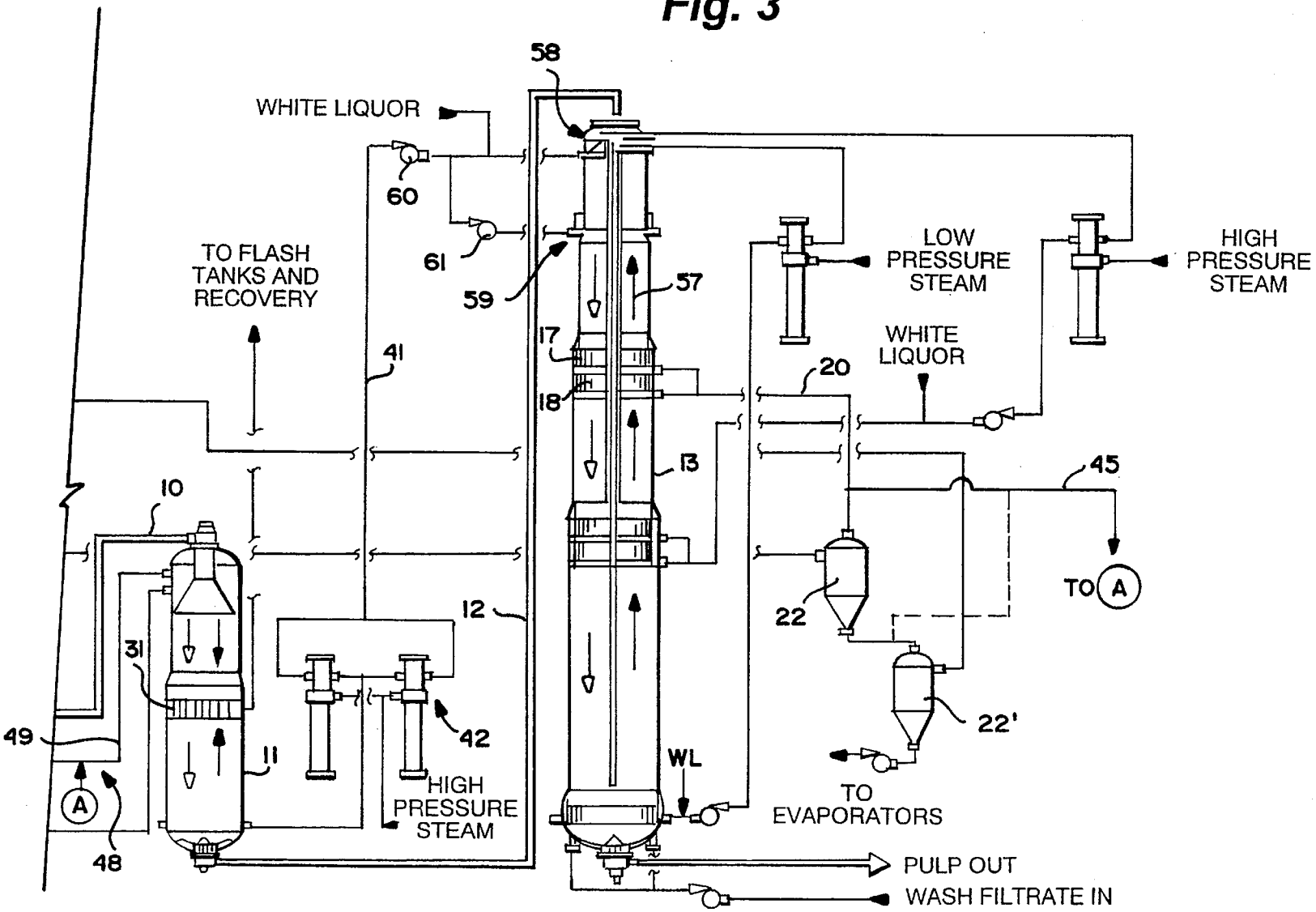
FIG. 3 is a view like that of FIG. 2 only not showing the chip bin and other conventional components, and showing a countercurrent liquor flow in the top of the digester.

FIG. 3 illustrates a system similar to that in FIG. 2 and the same components are illustrated by the same reference numerals. In this embodiment, however, there is a counter-current liquid flow in the top of the digester 13, as indicated by the arrow 57. A bottom circulation screen illustrated schematically at 58 acts as a top separator in FIG. 3. In this case, then, the "first screen" for withdrawing the first spent liquor (sulphurous liquor) is either the trim screen, illustrated schematically at 59, or the bottom circulation screen (e.g. 58), or a combination of both, both screens 58, 59 being conventional in a two vessel hydraulic system, and associated with the recirculation line 41, and having the conventional pumps 60, 61, respectively, associated with screens 58, 59. Therefore in this embodiment the sulphurous liquor is returned to the bottom of the impregnation vessel 11, to flow upwardly therein, by the conventional recirculation line 41.

Figure 4:
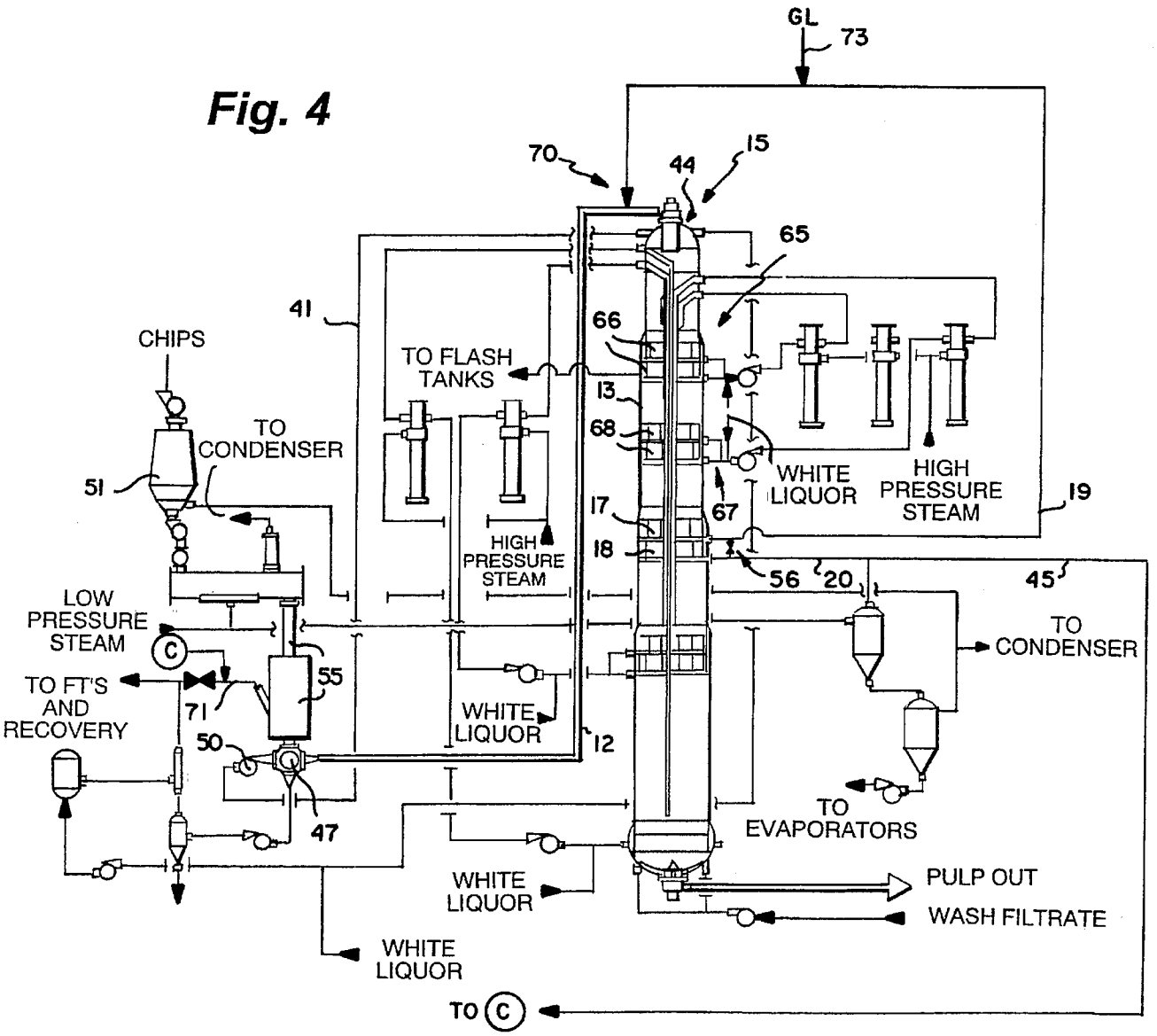
FIG. 4 is a view like that of FIG. 2 for a single vessel hydraulic EMCC® digester system.

FIG. 4 illustrates the application of the teachings of the invention to a conventional single vessel hydraulic digester system. The FIG. 4 system is very similar to that of FIG. 2, and comparable components to the FIG. 2 embodiment are shown by the same reference numeral, except that there is no impregnation vessel.

In the FIG. 4 embodiment, a conventional cooking circulation loop 65, including an upper screen set 66, is associated with the digester 13 above the first and second extraction screens 17, 18, but below top separator 44. A second cooking recirculatory loop 67, with associated screens 68, also may be provided. In the embodiment of FIG. 4 the bulk of the impregnation of the chips with cooking liquor takes place in the transfer line 12 and adjacent the top 15 of the digester 13, while normally cooking takes place from about the level of screen 66 down to the extraction screens 17, 18. In the FIG. 4 embodiment the first spent liquor (sulphurous liquor) in conduit 19 may be introduced into the chips in the transfer line 12, as indicated at reference numeral 70 in FIG. 4, while the second spent liquor (black liquor) in line 45 may be introduced into the conduit 71 associated with the slurrying vessel/chute 55 which supplies slurried steamed chips to the high pressure feeder 47.

Alternatively, in a single vessel hydraulic system as seen in FIG. 4 the strong (first) spent liquor may pass counter-currently in situ as in the counter-current mode at the top of the digester 13 in FIG. 3. In this case an extraction must be taken from one of the upper digester screens in FIG. 4 so that a counter-current flow of liquor results below the screen, yielding a higher sulfidity liquor during the early stages of cooking. The extraction from the upper screen would then typically be taken to one or more flash tanks, and to conventional chemical recovery.

The sulphur content of the sulphurous liquid in conduit 19 may be enhanced by using green liquor as a source of sulfide. Green liquor is an aqueous solution of primarily sodium carbonate and sodium sulfide. In conventional practice the carbonate is causticized to NaOH to produce white liquor. The sulfide in green liquor can perform the same function as sulfide of the first spent liquor in line 19. Green liquor may be added to either of the first or second spent liquors in lines 19, 20 to enhance sulfidity, although typically any green liquor added would be added to the first spent liquor in line 19, as illustrated at 73 in FIG. 4 (green liquor may also be used in the FIGS. 1–3 embodiments too, typically added to line 19 although it could be added elsewhere). When used, the added green liquor volume may be from just above 0 to about 2 $m^3$/ton of pulp.

While the embodiments illustrated in FIGS. 2 through 4 illustrate a number of different embodiments it is to be understood that they are only exemplary and that the teachings of the invention in which two different spent liquor streams having effective alkali and $Na_2S$ concentrations which both differ by at least 25% (and preferably by at least 50%) are utilized, can be applied to almost any conventional continuous digester system.

In a single extraction black liquor recirculation described in the prior art the sulfide concentration is diluted by the combined extraction of spent cooking liquor and washing liquor. However in the present "double-extraction" process the two liquors are separated and the stronger liquor is not diluted by wash liquor. For example, for cooking systems with white liquor having typical values of 140 g/l active alkali (at least 100 g/l) and about 35% sulfidity (typically at least about 25% sulfidity, although split sulfidity streams can be used) the relative sulfide concentrations of the two different liquors is at least 25% (i.e. a ratio of at least 1.25:1), and typically more on the order of between about 2:1 to 4:1. One particular example, where the white liquor has 140 g/l active alkali and 35% sulfidity, is provided in Table I below. In Table I what is referred to as "strong" liquor corresponds to the first spent liquor in line 19 in the exemplary embodiments of FIGS. 1 through 4, while what is described as "weak" black liquor is the second spent liquor in conduit 20 illustrated in the drawings and as described above.

TABLE I

Comparison of Sulfide Concentrations of Extracted Liquors
Assume white liquor sulfidity is 35% and active alkali is 140 g/l.
Assume weak liquor extracted contains 30% of the total volume of added white liquor, which is typical for MCC ® and EMCC ® style digesters.

| Components of Extracted Liquor | Prior Art | Dual Extraction of Invention | |
|---|---|---|---|
| ($m^3$/ton of wood) | Single Extraction | Weak | Strong |
| Total Extracted Liquor | 3.0 | 1.6 | 1.4 |
| $Na_2S$ Concentration in Extracted Liquor (g/l) [as NaOH] | 15 | 9 | 25 |

Figure 5:
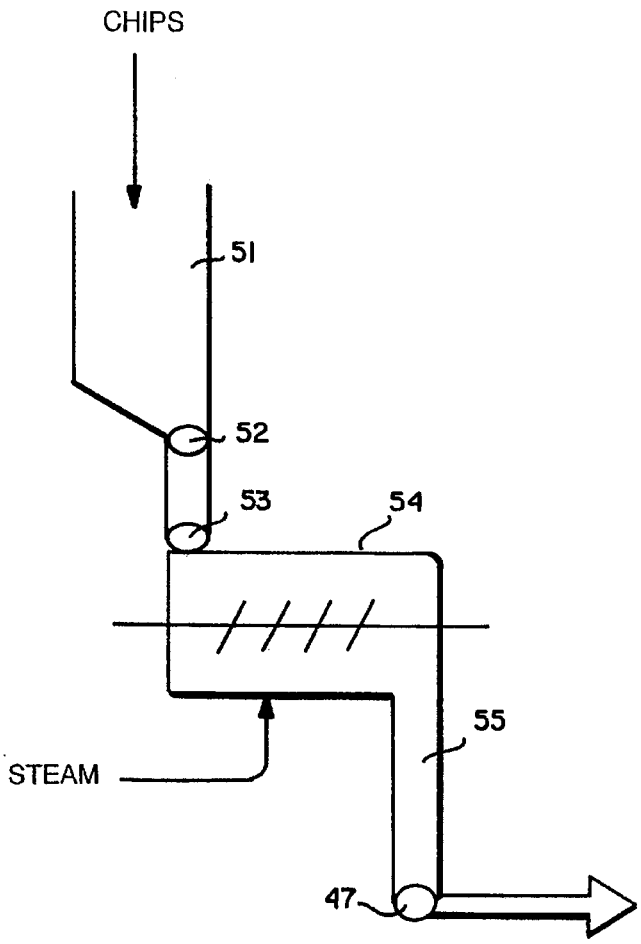
Fig. 5 (PRIOR ART)
FIG. 5 is a schematic view of a conventional prior art chip feeding system for a continuous digester.
Figure 6:
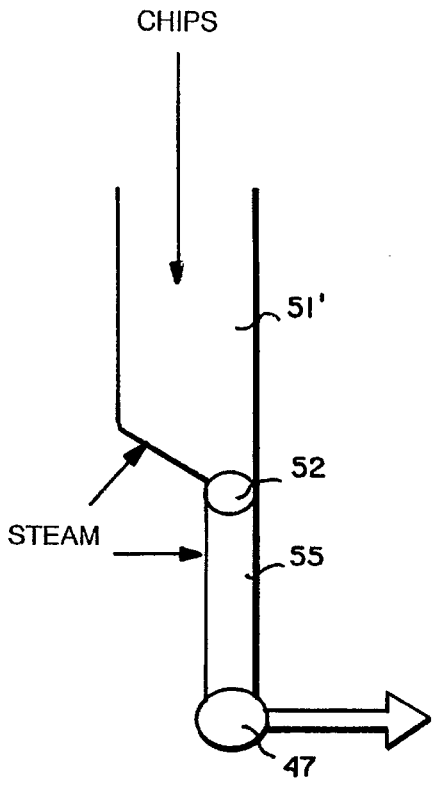
FIG. 6 is a schematic side view of a modified chip feeding system for a continuous digester that may be utilized in the practice of the present invention.

Utilizing the teachings of the present invention it is also possible to simplify the steaming/slurrying system associated with the digester 13 and/or impregnation vessel 11. FIG. 5 schematically shows a conventional prior art system, similar to that illustrated in FIG. 2, in which a pressurized chip bin 51, chip meter 52, low pressure feeder 53, horizontal steaming vessel 54, and slurrying vessel/chute 55 are associated with the high pressure feeder 47 to steam and slurry the chips. The use of the steaming vessel 54 typically results in the temperature at the top of the impregnation vessel 11 being above 100° C., usually about 120° C., and the low pressure feeder 53 is necessary to isolate the significantly different pressures of the chip bin 51 and chip meter 52 from the steaming vessel 54. However according to the present invention, a lower temperature can be held at the top of the impregnation vessel 11. Thus the feed/slurrying system illustrated in FIG. 6 can be utilized, in which just the chip bin 51', chip meter 52, and slurrying vessel/chute 55 may be utilized. If the temperature in the top of the s0 impregnation vessel 11 is slightly below 100° C., which is possible in some instances (although not all), the chips are presteamed to only about 100° C. in the unpressurized chip bin 51' [slightly different than the pressurized chip bin 51, and simpler].

Figure 7:
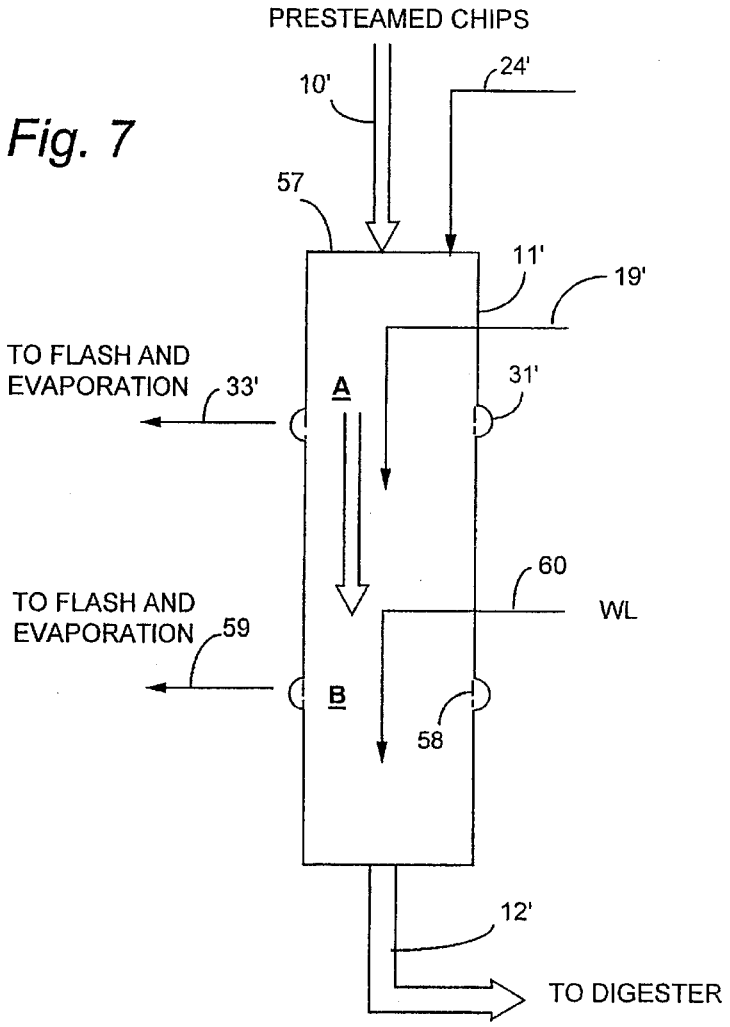
FIG. 7 is a schematic view of a co-current two stage impregnation system.
Figure 8:
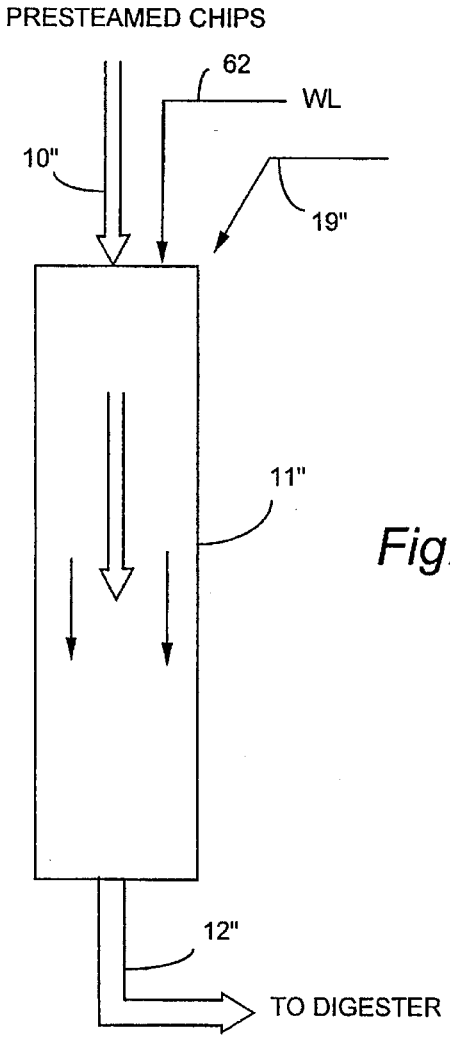
FIG. 8 is a schematic view of a conventional co-current impregnation system which may be used with strong spent liquor from a continuous digester.

Countercurrent impregnation and treatment of chips can be difficult as the chips may start to float thus preventing the countercurrent flow. An exemplary system for co-current treatment is shown in FIGS. 7 and 8, which illustrates an impregnation vessel 11'. All components in FIGS. 7 and 8 comparable to those in FIG. 1 are shown by the same reference numeral but with a following "'".

If the chips in FIG. 7 move downwardly together with the weaker spent liquor from 24' (from flash tank 22 in FIG. 1) in the top 57 of the impregnation vessel 11' (which may be, instead of a separate impregnation vessel 11; the top of a single vessel digester), after a suitable time (e.g. 1–30 minutes) the liquor is displaced by strong spent liquor from line 19' (screen 17 in FIG. 1). The extracted liquor in 33' goes to a flash tank (like 34 in FIG. 1) and then a conventional evaporator. After another 5–40 minutes white liquor or green liquor is added in line 60 before final impregnation and cooking (in a digester connected to line 12'). The temperature in region A may be 90°–140° C., and in region B 100°–160° C. Extraction also takes place from screen 58, passing in line 59 to a flash tank and/or evaporator.

Thus FIG. 7 discloses a two-stage co-current system. The system may be simplified by omitting region A and having only one set of extraction screens (e.g. 58). In this case the chips and the strong liquor from 19' are fed to the top 57, and a single stage impregnation system is provided.

FIG. 8 shows another way of effecting single stage co-current impregnation, the reference numerals that are for the same so structures as in FIGS. 1 or 7 are shown by the same reference numeral followed by "'". The chips and the cooking liquor (e.g. white liquor and weak spent liquor) are fed (as discussed above) in line 10" to the impregnation vessel 11". No screens are needed in the impregnation vessel 11" and there is no separate pretreatment with the strong spent liquor. The strong spent liquor added at 19" (e.g. from screen 17 in FIG. 1) acts directly together with the white liquor added in line 62.

Thus the way of utilizing the strong spent liquor can vary from two stage pretreatment (FIG. 7) to one stage pretreatment where white liquor is combined with strong spent liquor (FIG. 8). Combinations of these alternatives may also be provided. Some of them can be co-current and some countercurrent.

Example of a Cooking Method with Black Liquor Pretreatment

1. Water Balance

Water is added to a conventional cooking system as shown in FIG. 9. The white liquor in line 66 contains about 3 $m^3$ water per ton of pulp, the wood in line 67 contains about 2 $m^3$/tp water, and other minor sources, like condensate etc., in line 68 about 1 $m^3$ per ton of pulp. Thus about 6 $m^3$ of water enters the digesting or cooking zone 69. Wash liquor, expressed as a dilution factor, adds 3 $m^3$/tp in line 70 is also added to the washing zone 71, but this does not enter the cooking zone to any large extent.

Thus, in a conventional cooking system the concentration of cooking chemicals is diluted to about half from what it was in the white liquor before impregnation and cooking. In the white liquor we have 3 $m^3$ water but in the cooking zone 6 $m^3$. The strength of sulphide ions per liter of liquor will vary little as a function of sulfidity as the sulphur is diluted in a large volume of water. The sulfidity affects the cook mainly through the relationship $Na_2S$—NaOH, not through the strength of sulfide ions per liter.

In a system with black liquor pretreatment the situation will be quite different, as schematically shown in FIG. 10. The wood in line 67 contains 2 $m^3$ water and the minor sources like condensate, etc. in line 68 1 $m^3$, so that about 3 $m^3$ water enters the pretreatment zone 72. White liquor, containing 3 $m^3$ of water per ton of pulp enters the cooking zone, 73, at 66. Just prior to the end of the cooking zone, sulfide-rich liquor is extracted and recirculated, at 75, to pretreat the chips prior to cooking. After cooking the mother liquor is extracted in line 76 and used as displacement liquor (line 76) before cooking. This way water is prevented from entering the cooking zone 73. The dilution factor water in line 70, and line 76 from the washing zone is used at the beginning of the pretreatment zone 72 to soak the chips.

As can be seen, the only water entering the cooking zone 73 is thus white liquor, and ideally there is the same strength of chemicals in the cooking zone 73 as in the white liquor. In reality there will be non-ideal displacement before the cooking zone 73 but the difference compared to the conventional cooking is clear. One can raise the concentration of cooking chemicals, especially sulphide ions, per liter of liquor.

The role of the sulfidity will also be different in the inventive system of FIG. 10 compared to the conventional system of FIG. 9 due to two effects:

1. During cooking the relationship $Na_2S$—NaOH is changed as the NaOH is consumed but $Na_2S$ is only partially consumed. The recirculated mother liquor will be relatively poor in NaOH. By recirculating the mother liquor the $Na_2S$/NaOH ratio is changed in favor of $Na_2S$. The pretreatment system in FIG. 10 gives a high sulfidity effect.

2. The strength of sulphide ions per liter will be raised as less water enters the cooking zone. The amount of water in the white liquor depends on sulfidity. At 35% sulfidity the $Na_2S/Na_2CO_3$ ratio in green liquor will be 1:2. At 50% sulfidity the ratio will be 1:1 in the green liquor. The amount of water needed to dissolve the green liquor primarily depends on the $Na_2CO_3$ amount. Thus there is twice as much water per sulphide ion at 35% as at 50% sulfidity in the white liquor. A high sulfidity gives thus less water to the cooking zone 73 giving a higher strength of sulphide ions. White liquor added can also be evaporated to raise its strength, especially its strength [i.e. concentration] of sulfide ions.

Pretreatment with black liquor as shown in FIG. 10 (see line 75) will thus give two effects:

1. The $Na_2S$/NaOH ratio will be changed in favor of $Na_2S$.

2. The strength of sulphide ion per liter will be raised.

The role of sulfidity will be even more important than in conventional cooking. A high sulfidity will give a better $Na_2S$/NaOH ratio and a higher strength of sulfide ions in the cooking zone 73. Polysulfide may be added to further raise the sulfide to hydroxide ratio.

2. Continuous Cooking System

Figure 11:
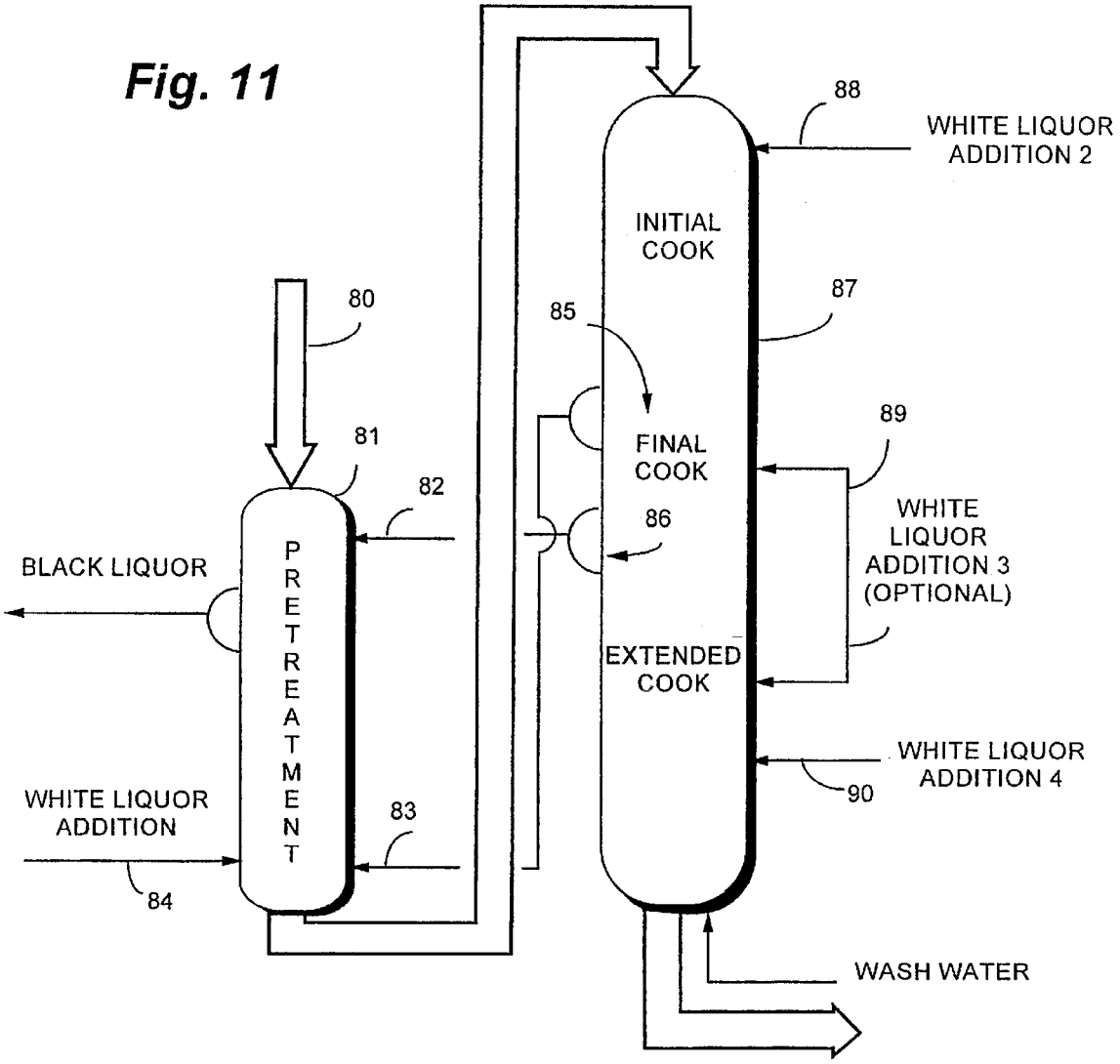
FIG. 11 is a schematic view of a cooking system of the present invention.

FIG. 11 illustrates a continuous cooking system with black liquor pretreatment. Presteamed chips in line 80 enter the impregnation vessel 81 where they are soaked with black liquor, in line 82. After this the chips are displaced with black liquor from the cooking zone, in line 83. White liquor, in line 84, may be added to this second phase. It is important that the time in the two pretreatment phases is long enough to allow time for the water in the chips to diffuse out of and the chemicals to diffuse into the chips. The best results can be obtained when the time is 60 to 120 minutes. This is, however, for practical reasons sometimes difficult to achieve, for example, 30 minutes is chosen.

The sorption of sulfide in wood chips increases with increasing hydrosulfide concentration, time and temperature but decreases with increasing concentration of hydroxide ions. The ratio of sulfide ions to hydroxide ions should be 2–15, preferably 6–7, in order to achieve a high sulfide sorption. Polysulfide may be added to further raise the sulfide to hydroxide ratio. A suitable temperature in the pretreatment phase is 120° to 160° C., preferably 130° . A temperature that is too low slows down the sorption and, a temperature too high starts cooking too early.

Organic material is dissolved during initial, final and extended cooking. The first extraction screen 85, for separating mother liquor, should be placed so that as much as possible of the organic material is still in the chips. As much as possible of the organic material should dissolve into the black liquor during the final cooking and the extended cooking and be separated in the second extraction screens 86. In this way there is a low accumulation of dissolved organic material in the cooking zone of digester 87 due to the recirculation of black liquor. Preferably the first black liquor after initial cooking, in line 82, is rich in sulphur but poor in dissolved organic material, and the second black liquor, in line 83, is rich in dissolved organic material.

3. Split Sulfidity

During cooking it is advantageous to use white liquor with a high sulfidity in WL addition points 84, 88 in FIG. 11. In WL addition points 89 and 90 the sulfidity should be low, since NaOH is the active component during the final cooking.

Figure 12:
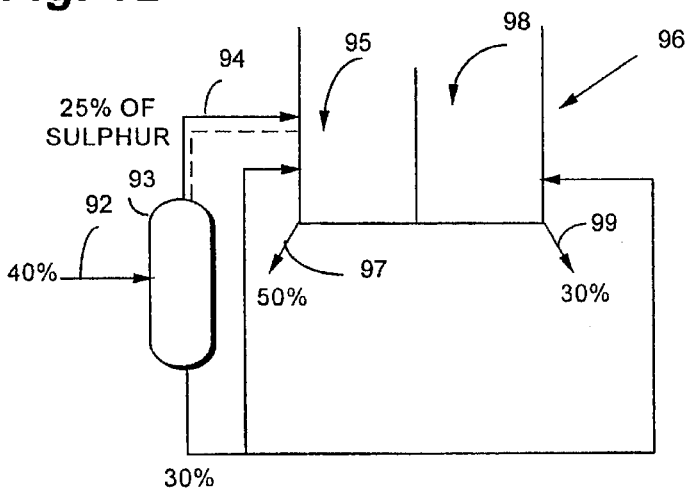
FIG. 12 is a schematic illustration of a preferred embodiment of a recovery system to be applied in connection with the present invention.

Two white liquors with different sulfidity can be produced as so shown in FIG. 12. As an example, black liquor in line 92 corresponding to a white liquor sulfidity of 40% is heat treated in vessel 93. 25% of the sulphur is separated during the heat treatment. The separated sulphur, in line 94, is burned together with black liquor in a first section 95 of the recovery boiler 96 to produce green liquor in line 97 with a high sulfidity. After the heat treatment, black liquor is burned in another section 98 of the recovery boiler 96 to produce another green liquor 99 with a low sulfidity.

By so modifying both the digestion system (FIG. 11) and the recovery boiler 96 a cooking and recovery system is created that gives better pulp quality than a conventional system without adding any new processes to the system. The cooking with the pretreatment system will also work without a split sulfidity system, but a split sulfidity system will further improve the cooking result.

4. Cooking Result

Using the technology described in this example pulps of both softwood and hardwood can be produced so that the kappa number thereof is extremely low—for example 15 to 10, or below. The strength properties will be good—especially tear strength is high.

The amount of sulfide that is absorbed on the wood is with good pretreatment 0.1–0.6 mole/kg wood, normally 0.2–0.4 mole/kg wood. Adding polysulfide raises this by a factor of 50 to 100%. Sulfide absorption being this high results in better cooking giving an increase in viscosity of 50–200 ml/g. The increase in tear strength is on the order of 5–20%.

EXAMPLES

Figure 13:
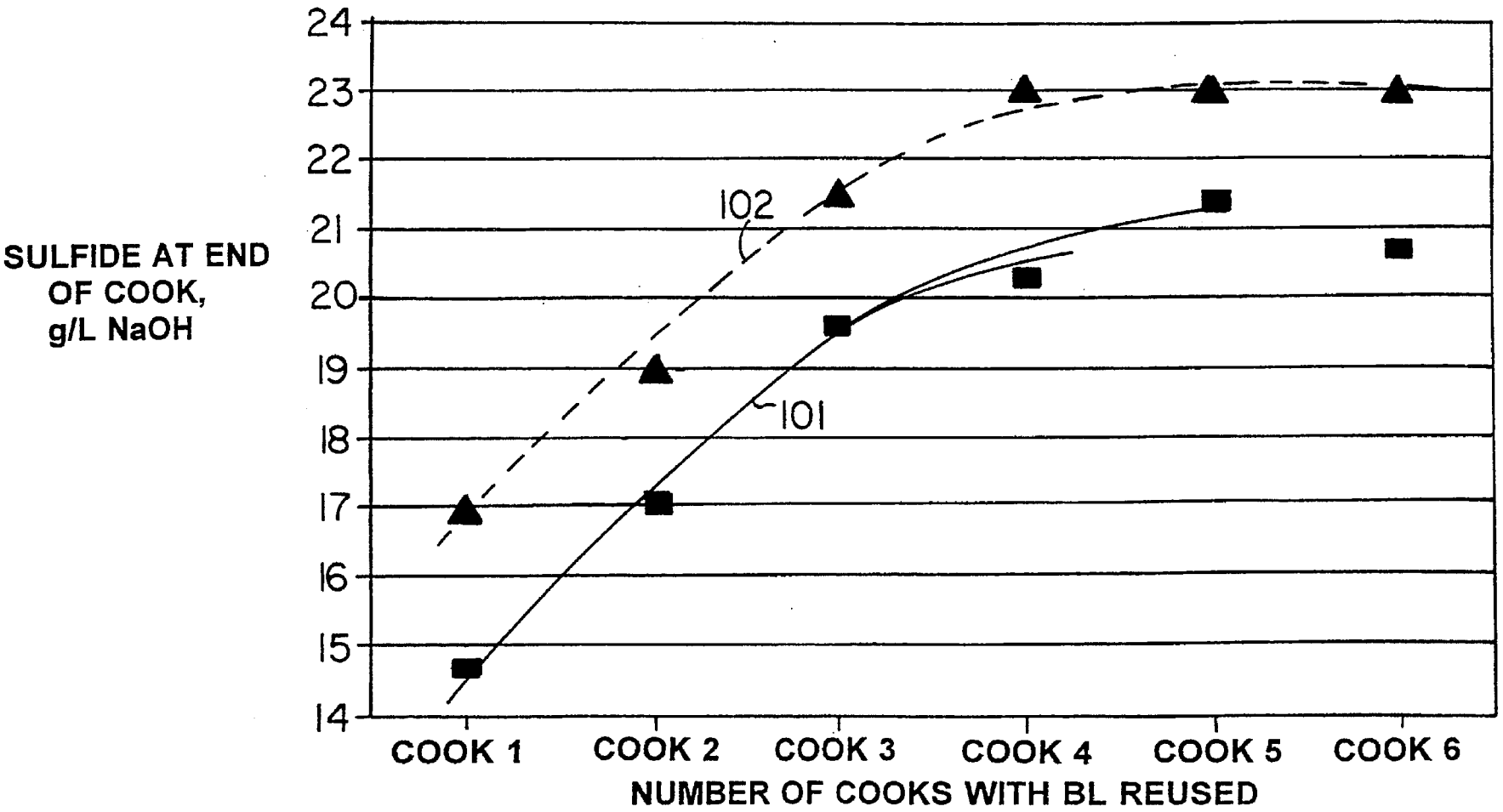
FIG. 13 is a graphical representation of the accumulation of sulfide that occurs according to the present invention.

Cooking according to the invention was done in a laboratory in such a way that six cooks were done in series. The spent liquor from the previous cook was used in pretreatment of the chips. This way the accumulation of sulfide occurring in a continuous process was simulated. FIG. 13 shows the accumulation of sulfide, i.e. the effect of liquor circulating when lab cooking a mixture of Northwest Softwoods, with the accumulated sulfide at the end of each cook (in g/l NaOH) plotted on the Y axis, and the six cooks on the X axis. Line 101 plots the results when using white liquor with 35% sulfidity, and line 102 white liquor with 40% sulfidity. A level at 20–25 gr/l of sulfide is reached after the iterations. This is about 50% higher than the original 14–17 gr/l expressed as gr NaOH/l.

Figure 14:
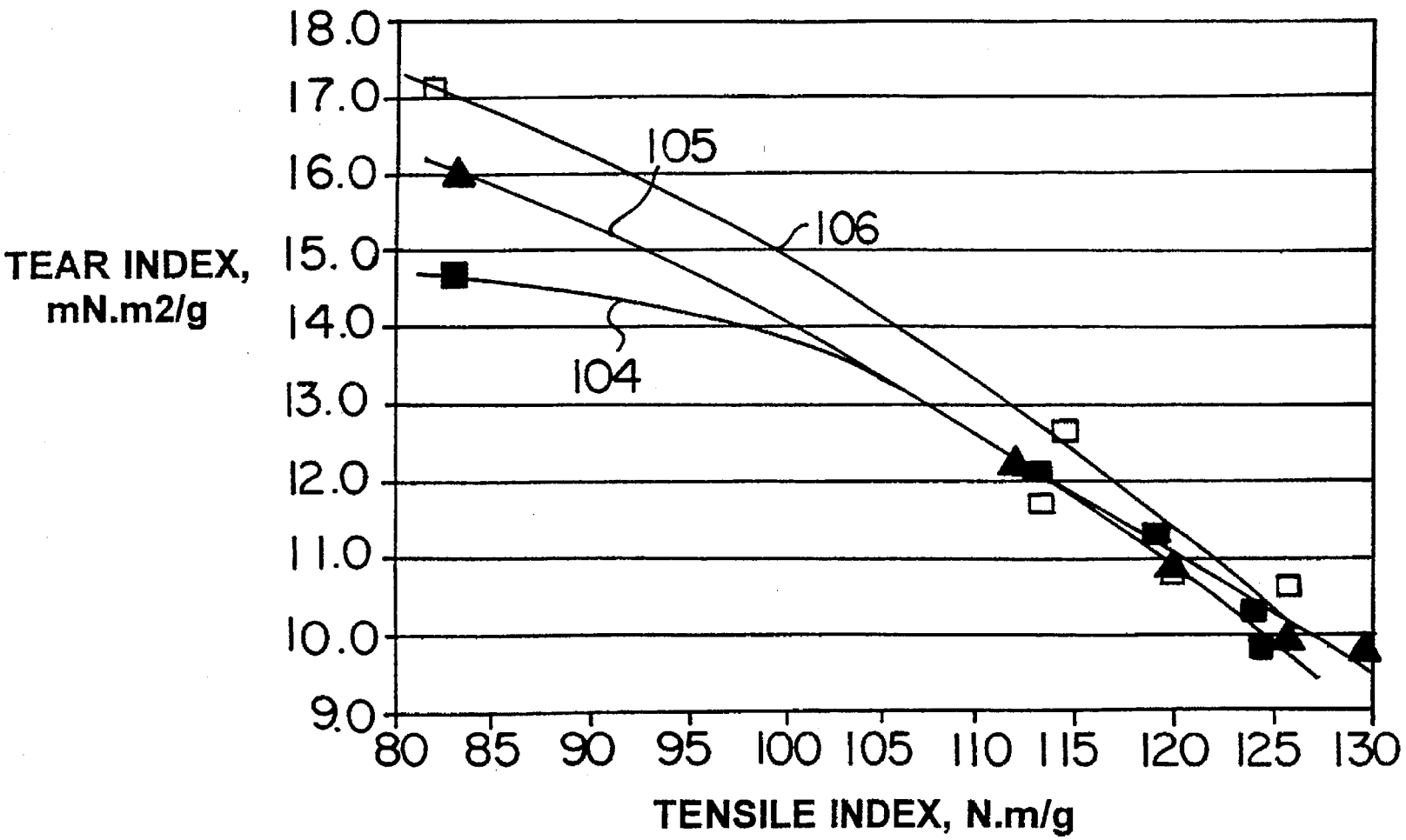
FIG. 14 is a graphical representation of the increase in strength properties as a result of the increase in sulfide when producing pulps according to the present invention.

With the sulfide accumulation illustrated in FIG. 13, a pulp with high strength values was produced. FIG. 14 shows representative strength data. In FIG. 14 the tear index, $mN.m^2/g$ is plotted on the Y axis while the tensile index mN.m/g is plotted on the X axis, utilizing the sulfide enriched lab cooks of Northwest Softwood brownstocks from FIG. 13. Line 104 illustrates graphically the strength data for conventional kraft pulp at a kappa of 31. Line 105 graphically represents pulp produced by sulfide enrichment by pretreatment at kappa 16 (according to the invention), while line 106 illustrates the strength data for pulp produced by sulfide enrichment by pretreatment at kappa 23 (according to the invention). It will thus be seen that the strength properties, for the same wood, are significantly increased when practicing the invention.

In an industrial scale test with batch digesters the strong spent liquor after some iterations reached a strength of 25 gr/l of active alkali and 15 gr/l of sulfide both expressed as gr NaOH/1. The original liquors had a strength of about 15 gr/l of active alkali and 10 gr/l of sulfide. These lower values (compared to the lab test) are due to the poor placement conditions in industrial batch digesters. A continuous cooking process can be expected to produce spent liquor closer to laboratory conditions and thus a continuous process will produce a stronger pulp at same kappa than a batch process.

Figure 15:
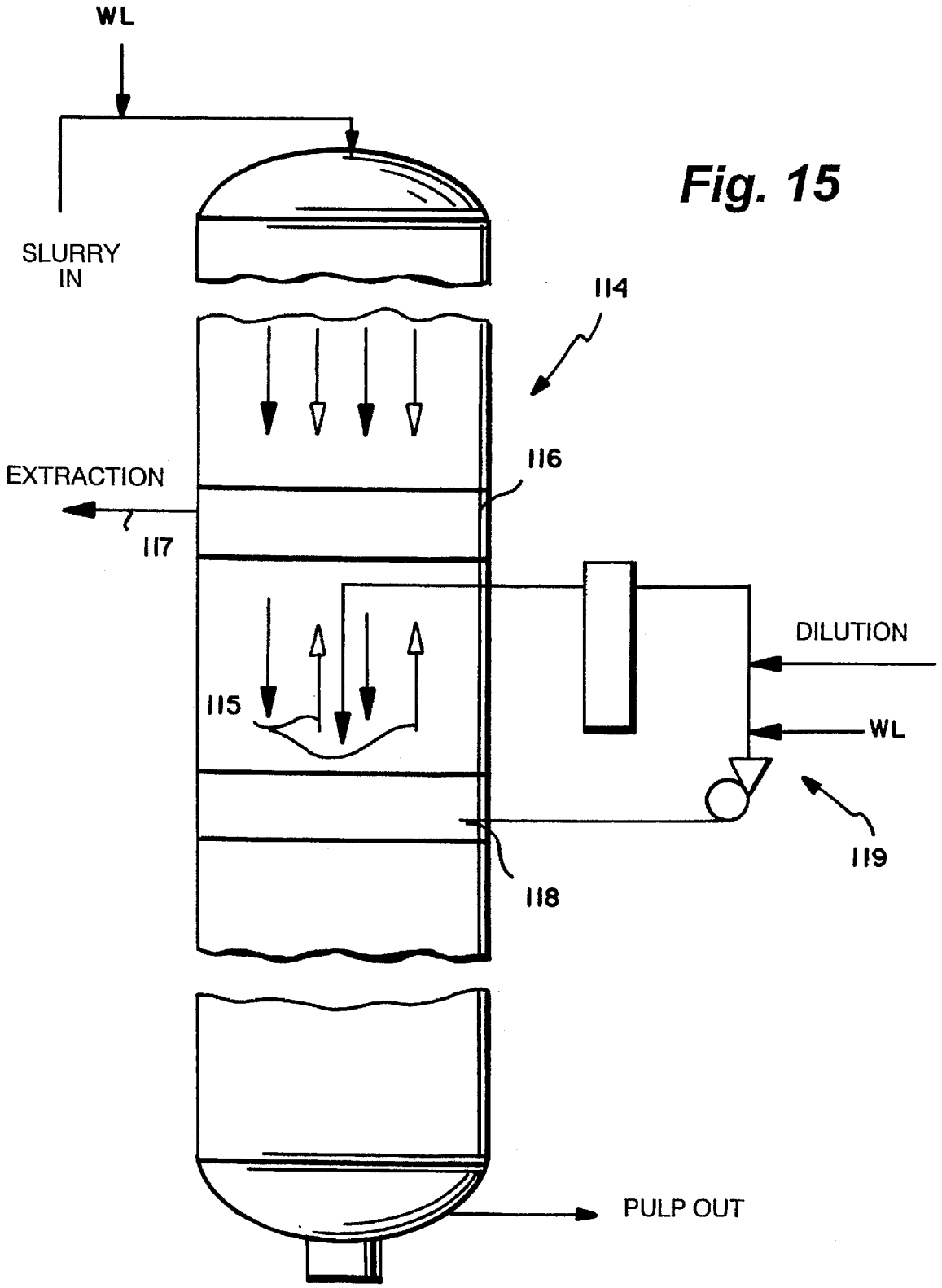
FIG. 15 schematically illustrates an embodiment according to the invention wherein the black liquor is internally circulated in the digester to achieve desired sulfide concentrations rather than being externally circulated.

FIG. 15 schematically illustrates an embodiment according to the invention in which the black liquor is recirculated internally of the digester 114. In the other drawings the illustrations primarily illustrate external recirculation of the black liquor in which the black liquor is removed from one part of the digester and transported out of the digester and then reintroduced to a desired impregnation point. However as illustrated schematically in FIG. 15, black liquor transport may not only occur externally but may also occur within the digester. For example utilizing the techniques such as shown in co-pending application Ser. No. 08/291,918 filed Aug. 18, 1994 (the disclosure of which is hereby incorporated herein), it is possible to adjust liquor flows within the digester to achieve desired sulfide concentrations. The internal black liquor recirculation is illustrated schematically at 115 in FIG. 15, for the continuous digester 114; the black liquor is made to flow countercurrently within the digester 114 so that alkali is consumed and sulfide increased. Extraction 117 takes place from screen 116, and screen 118 is used to remove liquor to be recirculated in loop 119.

According to the invention the pulp may be first treated with a weak black liquor for 10–50 minutes at 90°–100° C. (Note that this treatment may last from 10 to 120 minutes, but is preferably 10–30 minutes long; the temperature range may vary from 80° to 110° C., but is preferably 90° to 100° C.) During this treatment, 4–8% of the wood material dissolves and sulfur is absorbed on the chips. White liquor or green liquor may be added to control the alkalinity so that it is high enough (e.g. a suitable level of effective alkali is 5–10 gr/l). The pulp is then treated with a strong black liquor for 20–30 minutes at 110°–150° C. (again, this treatment may also last from 10 to 120 minutes, but is preferably 10–30 minutes long; the temperature range may also vary from 100° to 150° C., but is preferably 120°–130° C.). 4–10% of the wood material is dissolved during this treatment. White liquor or green liquor may be added to control the alkalinity so that it is high enough (e.g. a suitable level of effective alkali during this second treatment is 15–25 gr/l). Thus 15–20% of the wood material dissolves during the pretreatment. By adding the white liquor in such a way that it displaces the liquid, or part of the liquid, present during the pretreatments, a low level of dry solids can be reached in the digester. It is usually desirable for the pulp quality to control the alkalinity as is done during the pretreatments herein described because there is a risk of fiber damage if the alkalinity is too low during pretreatment.

It will thus be seen that according to the present invention an advantageous method and system are provided for optimizing the production of kraft pulp. Utilizing the method and apparatus of the invention it is possible to provide a more selective cook, with the potential to cook to a lower kappa (easily below 20).

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of continuously kraft cooking comminuted cellulosic fibrous material utilizing an upright continuous digester having first and second extraction screens, a top, and a bottom, comprising the steps of continuously:

(a) feeding comminuted cellulosic fibrous material slurry to the top of the digester;

(b) cooking the material in the digester as it passes downwardly therein with a cooking liquor, at a cooking temperature of about 150°–180° C., producing spent liquor during cooking while digesting the material;

(c) using the first extraction screen, withdrawing a first spent liquor from the digester having a first amount of effective alkali concentration between about 10–50 g/l and a first $Na_2S$ concentration;

(d) using the second extraction screen, withdrawing a second spent liquor from the digester having a second $Na_2S$ concentration, which is at least 25% less than said first $Na_2S$ concentration;

(e) combining at least some of the first spent liquor with the material prior to step (b) to allow useful chemicals to react and to enhance the amount of sulfur present at the beginning of step (b);

(f) withdrawing black liquor, distinct from the first and second spent liquors, from the material slurry resulting from step (e), and passing the black liquor to recovery; and (g) withdrawing pulp from the bottom of the digester.

2. A method as recited in claim 1 wherein step (c) is practiced to extract as the first spent liquor a liquor having an $Na_2S$ concentration of greater than about 15 g/l.

3. A method as recited in claim 2 wherein step (d) is practiced to extract as the second spent liquor a liquor having an $Na_2S$ concentration of less than about 20 g/l, and less than the first liquor.

4. A method as recited in claim 3 wherein step (d) is further practiced to extract the second liquor having a temperature of about 120°–160° C. and in an amount of about 2–6 $m^3$/ton of wood.

5. A method as recited in claim 2 wherein step (c) is further practiced to extract the first liquor having a temperature of about 140°–180° C. and in an amount of about 2–6 $m^3$/ton of wood, and wherein the second liquor has an $Na_2S$ concentration of at least 50% less than that of the first liquor.

6. A method as recited in claim 1 comprising the further steps of (h) flashing the second spent liquor to produce steam and more concentrated second spent liquor, and then (i) using the more concentrated second spent liquor to slurry the comminuted cellulosic fibrous material prior to step (b).

7. A method as recited in claim 6 wherein a high pressure transfer device, having a feed circulation loop, feeds slurry to the top of the digester; and wherein step (i) is practiced to introduce the more concentrated second spent liquor into contact with the material in the feed circulation loop of the high pressure transfer device.

8. A method as recited in claim 1 comprising the first step of using the second liquor to slurry and treat the cellulosic material prior to step (b), and adding alkali in the form of white liquor or green liquor to the second liquor prior to using it for slurrying and treating.

9. A method as recited in claim 1 comprising the further step of adding alkali in the form of white liquor or green liquor to the first liquor prior to the use thereof.

10. A method as recited in claim 1 comprising the further steps of using the second liquor to slurry the cellulosic material and adding alkali in the form of white liquor or green liquor to the first or second liquor prior to the use thereof.

11. A method as recited in claim 1 wherein the first spent liquor has a first amount of effective alkali, and wherein the second spent liquor has a second amount of effective alkali at least 25% less than the first amount.

12. A method as recited in claim 1 wherein the second spent liquor has an effective alkali concentration of about 10–50 g/l, and the second a concentration of about 3–20 g/l.

13. A method as recited in claim 1 wherein step (c) is practiced to produce as the first spent liquor a liquor having an effective alkali concentration of the first spent liquor is about 20 g/l.

14. A method of continuously digesting comminuted cellulosic fibrous material to produce cellulose pulp in a continuous digester, comprising the steps of substantially consecutively and continuously:

(a) slurrying the material with liquor;

(b) treating the material with a first sulphurous liquor having an effective alkali concentration of between about 10–50 g/l, and a first $Na_2S$ concentration;

(c) cooking the material by adding a cooking liquor having an effective alkali concentration of over 100 g/l and a sulfidity of at least about 25%, to the material, and operating step (c) at a cooking temperature of about 150°–180° C. to produce pulp and a first sulphurous liquor;

(d) separating the first sulphurous liquor from the pulp by extracting the first liquor from the digester;

(e) separating a second liquor from the pulp having a different $Na_2S$ concentration than the first liquor by extracting the second liquor from the digester; and (f) washing the pulp.

15. A method as recited in claim 14 wherein step (a) is practiced, at least in part, using the second liquor from step (e).

16. A method as recited in claim 14 wherein step (d) is further practiced to extract the first liquor having a temperature of about 140°–180° C. and in an amount of about 2–6 $m^3$/ton of wood, and with an $Na_2S$ concentration of about 15–30 g/l.

17. A method as recited in claim 16 wherein step (e) is further practiced to extract the second liquor having a temperature of about 120°14 160° C. and in an amount of about 2–6 $m^3$/ton of wood.

18. A method as recited in claim 14 wherein step (e) is practiced to extract as the second liquor a liquor having an effective alkali concentration of about 3–20 g/l, and less than the effective alkali concentration of the first liquor, and having an $Na_2S$ concentration of less than about 20 g/l.

19. A method as recited in claim 14 comprising the further step of adding alkali in the form of white or green liquor to the first or second liquor prior to the use thereof.

20. A method as recited in claim 13 wherein step (b) is practiced utilizing a liquor having an effective alkali concentration of about 20 g/l.

21. A method of continuously cooking comminuted cellulosic fibrous material in a continuous digester, comprising the steps of continuously:

(a) cooking comminuted cellulosic fibrous material at a cooking temperature of between about 150°–180° C. to produce a first spent cooking liquor having an effective alkali concentration of between 10–50 g/l, and to produce a second spent liquor having a second effective alkali concentration and second $Na_2S$ concentration each of which are at least 25% less than those of the first spent liquor;

(b) separating the first spent liquor from the material;

(c) treating the material prior to step (a) with the first spent liquor;

(d) removing black liquor, distinct from the first spent liquor, from the material and passing the black liquor to recovery;

(e) adding white liquor to the material between steps (c) and (a);

(f) separating the second spent liquor from the material by withdrawing the second liquor from the digester;

(g) treating the material prior to step (c) with the second spent liquor to produce black liquor, distinct from the first and second spent liquors; and practicing step (d) between steps (g) and (c).

22. A method as recited in claim 21 wherein step (a) is practiced to extract as the first spent liquor a liquor having an $Na_2S$ concentration of greater than about 15 g/l.

23. A method as recited in claim 21, wherein step (b) is practiced to produce a first spent liquor a liquor having a temperature of about 140°–180° C. and in an mount of about 2–6 cubic meters per ton of wood, and with an $Na_2S$ concentration of about 15–30 g/l.

24. A method as recited in claim 21 wherein during the practice of step (c) the material is treated with the first spent liquor for at least 10 minutes.

25. A method as recited in claim 24 wherein during the practice of step (c) the material is treated with the first spent liquor at a temperature of between 100°–150°.

26. A method as recited in claim 21 wherein during the practice of step (c) the material is treated with the first spent liquor between 10–30 minutes.

27. A method as recited in claim 21 wherein during the practice of step (c) the material is treated with the first spent liquor at a temperature of between 120°–130°.

28. A method as recited in claim 21 wherein step (d) is practiced using a screen in an impregnation vessel.

* * * * *